US005788809A

United States Patent [19]

Brennan

[11] Patent Number: 5,788,809

[45] Date of Patent: Aug. 4, 1998

[54] SELF ALIGNING CLAMPING DEVICE

[76] Inventor: David G. Brennan, HC0 1 MLP Box 1, Hudson, N.Y. 12534

[21] Appl. No.: 796,019

[22] Filed: Feb. 5, 1997

[51] Int. Cl.[6] ..... B30B 15/00

[52] U.S. Cl. ..... 156/581; 156/580; 81/424; 81/426; 269/258

[58] Field of Search ..... 81/418, 420, 421, 81/424, 424.5, 426, 426.5; 269/258; 156/580, 581

[56] References Cited

U.S. PATENT DOCUMENTS

| | | | |
|---|---|---|---|
| 1,262,621 | 4/1918 | Beacham | 81/424 X |
| 1,334,965 | 3/1920 | Ridings | 81/424 X |
| 1,427,550 | 8/1922 | Ridings | 81/424 X |
| 1,561,833 | 11/1925 | Cruickshank | 81/424 X |
| 1,617,703 | 2/1927 | Christianson | 81/424 X |
| 3,779,108 | 12/1973 | Reiter | 81/424 |
| 3,964,352 | 6/1976 | Dukes | 81/426 |
| 4,299,146 | 11/1981 | Phelps | 81/420 |
| 4,776,079 | 10/1988 | Cameron | 81/426.5 X |
| 5,143,359 | 9/1992 | Bush | 81/424 X |

*Primary Examiner*—James Sells

[57] ABSTRACT

A self aligning clamp for fixturing two items of unequal thickness together in a stationary relationship in a vice device prior to joining the items together by welding, glueing or the like is disclosed. The self aligning clamping device has a fixed rigid lower jaw adapted to receive an underside of the two items of unequal thickness together in a stationary co-planar relationship, the lower jaw being disposed transversely to the vice device and further having a lower region adapted for releasable communication with a lower extent of the vice device, each jaw still further having a solid cylindrical shape for urging continuous, rigid, unbending contact communication with the upper side of each item. Further the clamping device has a swivel having paired, spaced apart, downwardly disposed jaws adapted to receive an upper side of the two items of unequal thickness together in a stationary non-planar relationship, each downwardly disposed jaw being oriented above the lower jaw and being disposed parallel to the vice device. The swivel further has an aperture in a middle region adapted for threadable, rivetable communication with an upper extent of the vice device, and each jaw still further has a solid cylindrical shape for urging continuous, rigid, unbending contact communication with the upper side of each item.

1 Claim, 5 Drawing Sheets

SELF ALIGNING CLAMPING DEVICE

BACKGROUND OF THE INVENTION

1. Field of the Invention

The present invention relates to a new and improved self aligning clamping device and, more particularly, to a clamping device for holding two items of unequal thickness together in a stationary relationship prior to joining together by welding, brazing, soldering, glueing or the like, wherein both the upper and lower surfaces of a point of contact between the items is accessible during welding, glueing or the like.

2. Description of the Prior Art

The use of clamps and pliers for use in holding items of various thicknesses together in various designs and configurations for welding and glueing purposes is known in the prior art. More specifically, clamps and pliers for use in holding items of various thickness together in various designs and configurations heretofore devised and utilized for the purpose of gripping and locking together in a vice through innumerable designs and apparatus' are known to consist basically of familiar, expected, and obvious structural configurations, notwithstanding the myriad of designs encompassed by the crowded prior art which has been developed for the fulfillment of countless objectives and requirements.

The prior art discloses a large number of clamps and pliers for use in holding items of various thicknesses together in various designs and configurations for welding and glueing purposes. By way of example, U.S. Pat. No. 4,299,146 to Phelps discloses a clamping device that employs both a top rectangular plate and a bottom rectangular plate coupled to the jaws thereof. The bottom plate has a pair of contact points situated on opposite ends thereof, namely pivoting frusto-conical supports. When utilizing such device to clamp two flat rectangular members of different thicknesses together, the frusto-conical supports abut the flat members distant the point in which the members contact each other. Further, the top rectangular plate of the device of Phelps engages a majority of the upper surface of the flat members adjacent the point of contact. In use, this proves to afford serious deficiencies in that the upper surface of the point of contact between the flat members is inaccessible during welding and glueing. As such, removal of the flat members and the reinsertion thereof in a flipped orientation is required, a tedious and inconvenient procedure.

In this respect, the self aligning clamping device according to the present invention substantially departs from the conventional concepts and designs of the prior art, and in doing so provides an apparatus primarily developed for the purpose of holding two items of unequal thickness together in a stationary relationship prior to joining together by welding, glueing, brazing, soldering, or the like, wherein both the upper and lower surfaces of a point of contact between the items is accessible during welding, glueing, or the like.

Therefore, it can be appreciated that there exists a continuing need for a new and improved self aligning clamping device which can be used for holding two items of unequal thickness together in a stationary relationship prior to joining together by welding, glueing, brazing, soldering, or the like, wherein both the upper and lower surfaces of a point of contact between the items is accessible during welding, glueing, or the like. In this regard, the present invention substantially fulfills this need.

SUMMARY OF THE INVENTION

In view of the foregoing disadvantages inherent in the known types of clamps and pliers for use in holding items together in various designs and configurations now present in the prior art, the present invention provides a new and improved self aligning clamping device. As such, the general purpose of the present invention, which will be described subsequently in greater detail, is to provide a new and improved self aligning clamping device and methods which have all the advantages of the prior art and none of the disadvantages.

To attain this, the present invention essentially comprises a self aligning clamp for fixturing two items of unequal thickness together in a stationary relationship in a vice device prior to joining the items together by welding, glueing, or the like. The invention comprises a base having a fixed rigid lower jaw adapted to receive an underside of the two items of unequal thickness together in a stationary co-planar communication. The lower jaw is disposed transversely to the vice device and has a lower region adapted for releasable communication with a lower extent of the vice device. Each jaw has a solid cylindrical shape for urging continuous, rigid, unbending contact communication with the upper side of each item.

Finally, the invention has a swivel with paired, spaced apart, downwardly disposed jaws adapted to receive an upper side of the two items of unequal thickness together in a stationary non-planar communication. Each downwardly disposed jaw is oriented above the lower jaw and is disposed parallel to the vice device. The swivel has an aperture in a middle region adapted for threadable rivetable communication with an upper extent of the vice device, and each jaw has a solid cylindrical shape for urging continuous, rigid, unbending contact communication with the upper side of each item. The shape of the jaws is critical so that communication with the subject items is concentrated in a minimum area. As such, both the upper and lower surfaces of a point of contact between the items is accessible during welding, glueing or the like.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self aligning clamping device which has all the advantages of the prior art clamps and pliers for use in holding items together in various designs and configurations, and none of the disadvantages.

It is another object of the present invention to provide a new and improved self aligning clamping device which may be easily and efficiently manufactured and marketed.

It is a further object of the present invention to provide a new and improved self aligning clamping device which is of a durable and reliable construction.

An even further object of the present invention is to provide a new and improved self aligning clamping device which is susceptible of a low cost of manufacture with regard to both materials and labor, and which accordingly is then susceptible of low prices of sale to the consuming public, thereby making such a self aligning clamping device economically available to the buying public.

Still yet another object of the present invention is to provide a new and improved self aligning clamping device which provides in the apparatuses and methods of the prior art some of the advantages thereof, while simultaneously overcoming some of t he disadvantages normally associated therewith.

Even still another object of the present invention is, more particularly, for holding two items of unequal thickness together in a stationary relationship prior to joining together by welding, brazing, glueing, soldering, or the like, wherein both the upper and lower surfaces of a point of contact between the items is accessible during welding, glueing or the like.

Lastly, it is an object of the present invention to provide a self aligning clamp for fixturing two items of unequal thickness together in a stationary relationship in a vice device prior to joining the items together by welding, glueing or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
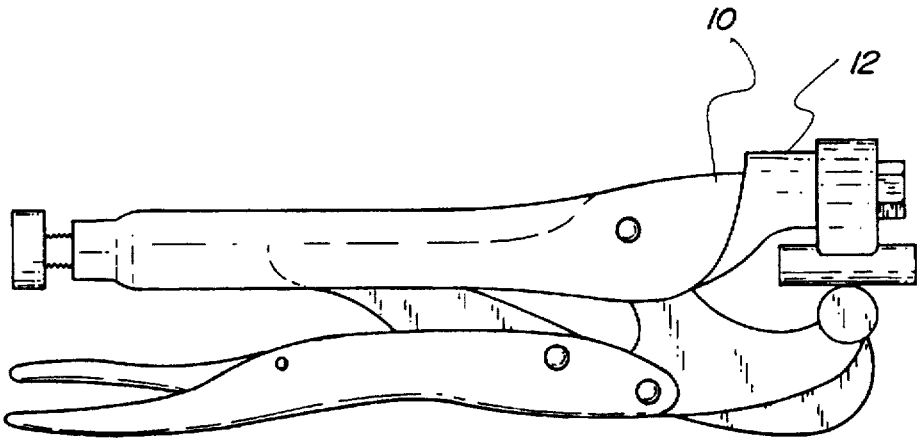
FIG. 1 is a perspective illustration of the preferred embodiment of the self aligning clamping device constructed in accordance with the principles of the present invention.

With reference now to the drawings, and in particular to FIGS. 1 through 8 thereof, the preferred embodiment of the new and improved self aligning clamping device embodying the principles and concepts of the present invention and generally designated by the reference numeral 10 will be described.

The present invention, the new and improved self aligning clamping device, is a system comprised of a plurality of components. The components in their broadest context include a base having a fixed lower jaw, and a swivel having paired upper jaws. Each of the individual components is specifically configured and correlated one with respect to the other to attain the desired objectives.

Referring to FIG. 1, the invention 10 is a vise or clamping device 12 configured to fixture two items of unequal thickness in a fixed non-movable relationship prior to joining the items together by welding, brazing, glueing or the like. Conventional clamping devices cannot be used for this type of work effectively because they do not allow adequate access to a majority of the area of abutment between the subject items to be welded.

Figure 2:
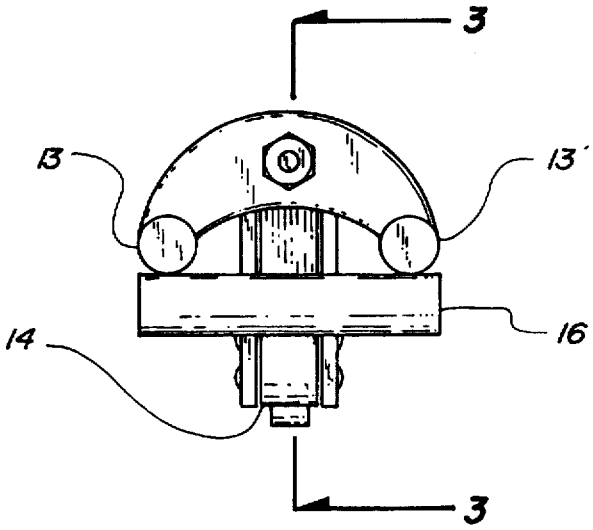
FIG. 2 is a right hand side view of the invention mounted on the vice grip pliers showing the lower jaw, the swivel and the downwardly disposed upper jaws and the bolt attachment to the vice grip pliers.
Figure 4:
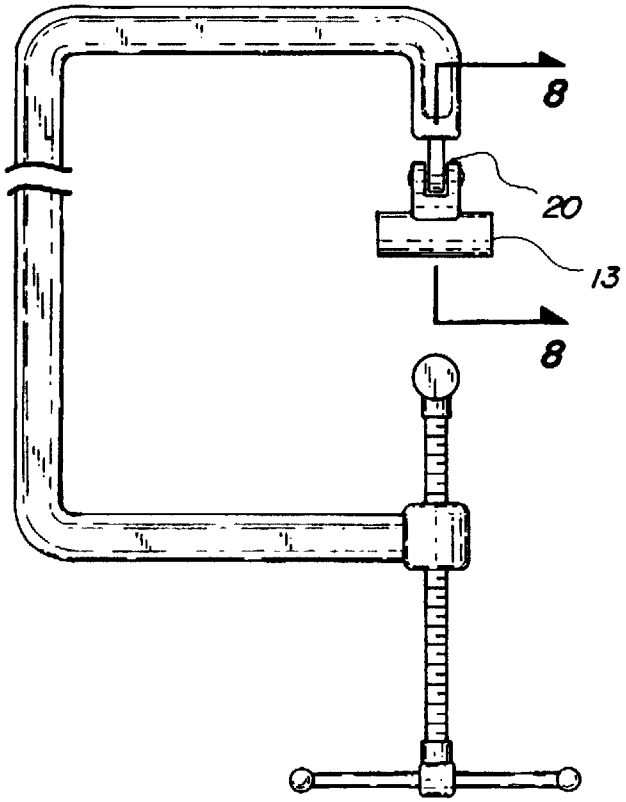
FIG. 4 is a front elevation view of the invention mounted on a conventional "C" clamp.
Figure 3:
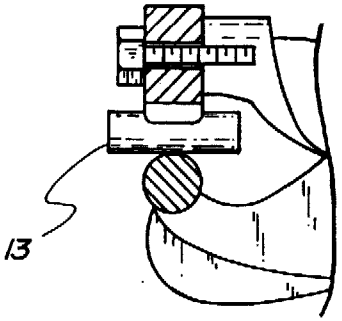
FIG. 3 is a cross-sectional view of the invention along viewing lines 3—3 in FIG. 2 showing the relationship between the fixed stationary lower base and the movable upper jaws.
Figure 6:
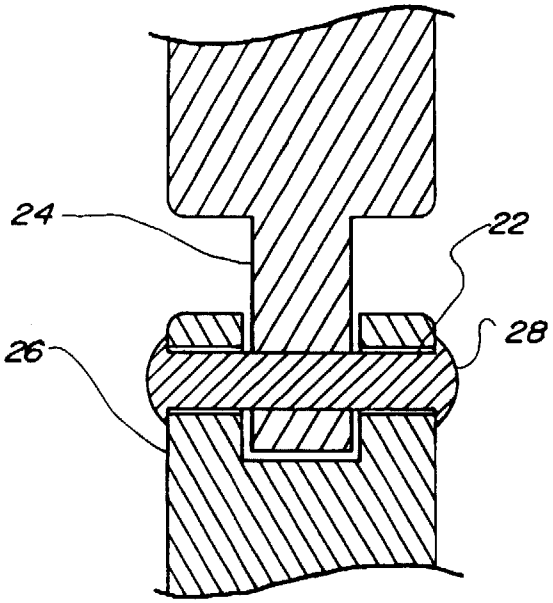
FIG. 6 is a cross-sectional view of the invention showing a rivet attachment for the swivel member to the "C" clamp taken along viewing line 6—6 in FIG. 5.

The present invention 10 has paired upper jaws 13, 13' which can accept parts of unequal thicknesses. As best seen in FIG. 2, the invention 10 has a base 14 with a fixed, rigid, lower jaw 16 that is adapted to receive an underside of the two items to be joined together in a stationary co-planer orientation. The lower jaw 16 with a cylindrical configuration is disposed transversely to the vise or clamping device 12 and further, has a lower region 18 that is adapted to releasably communicate with a lower extent 19 of the vise or clamping device 12. As best seen in FIG. 3, each jaw 13, 13' also has a solid cylindrical shape that urges continuous, rigid, unbending contact communication with the upper-side of each of the items to be joined together.

Further, the invention 10 includes a swivel 20 that is oriented and adapted to receive an upper side of the two items of unequal thickness together in a rigid stationary non-planer orientation. The swivel 20 is in rocking communication with the paired spaced apart downwardly disposed jaws 13, 13'. The jaws 13, 13' are adapted to receive the upper side of the two items of unequal thickness together prior to welding, glueing or brazing the items together. Each jaw 13, 13' is downwardly disposed and is oriented above the lower jaw 16 and is parallel to the vise or clamping device 12. The swivel 20 has an aperture 22 in a middle region 24 that is adapted for threadable, rivetable communication with an upper extent 26 of the vise or clamping device 12. In effect, the invention 10 has three lines of contact, one of which is fixed, while the others are at right angles to it and pivot about an axis which is perpendicular to the other.

Figure 5:
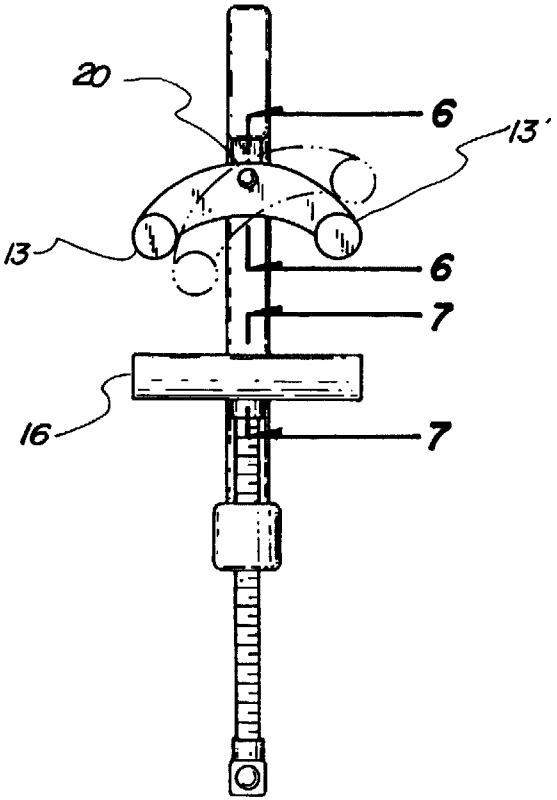
FIG. 5 is a right hand elevation side view of the invention mounted on a conventional "C" clamp as shown in FIG. 4.
Figure 8:
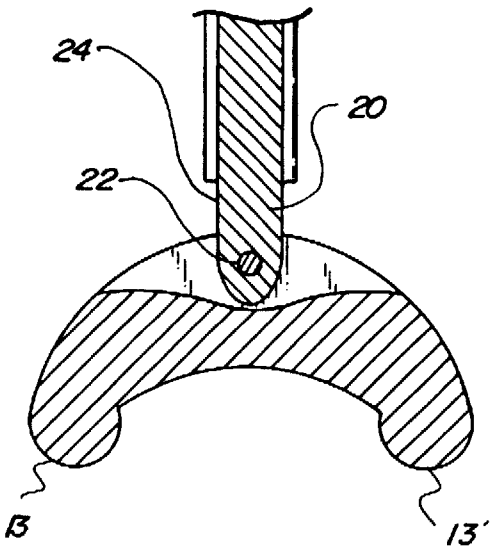
FIG. 8 is a cross-sectional view of the swivel member viewed along viewing line 8—8 in FIG. 4 showing the attachment means to the upper extent of the "C" clamp.
Figure 7:
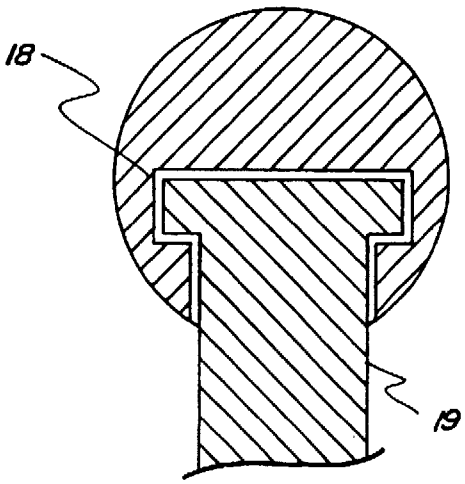
FIG. 7 is a cross-sectional view of the lower base member taken along the viewing line 7—7 in FIG. 5 showing the base being adapted for communication with the lower extent of the "C" clamp.

As best as seen in FIG. 5, each jaw 13, 13' has a solid cylindrical shape that urges continuous rigid unbending contact communication with the upper side of each item. Each jaw 13, 13' is free to pivot or rock on a rivet pin 28 disposed in the aperture 22 formed in a U-shaped member which connects the upper jaws. The upper jaws 13,13' are at right angles to the lower jaw 16.

Figure 9:
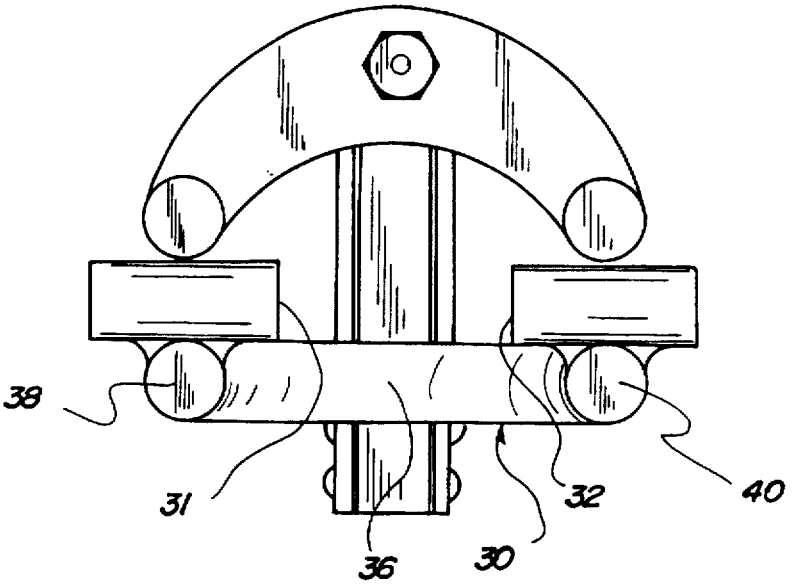
FIG. 9 is a right hand side view of an alternative embodiment of the invention mounted on the vice grip pliers showing the U-shaped lower jaw, the swivel and the downwardly disposed upper jaws, and the bolt attachment to the vice grip pliers.
Figure 10:
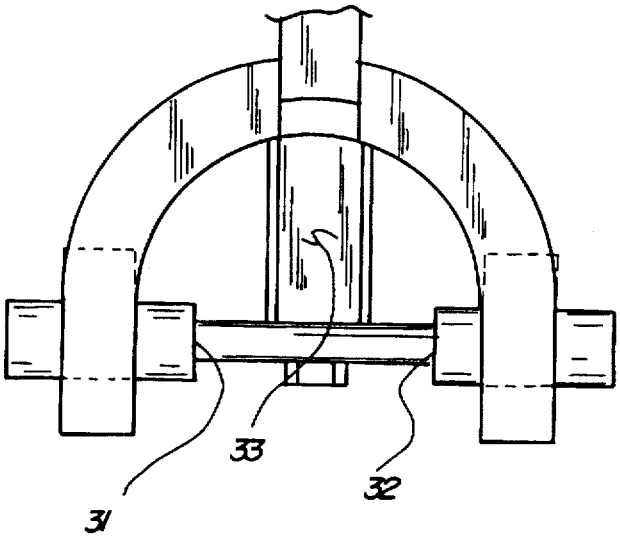
FIG. 10 is a bottom plan view of the apparatus shown in FIG. 9.

An alternative embodiment of the apparatus is shown in FIGS. 9 and 10. In such embodiment the fixed rigid lower jaw 30 is formed in a generally U-shaped configuration. The U-shaped lower jaw 30 is positioned horizontally and has an upper surface and a lower surface. The lower jaw has a curved inboard region 36 which is coupled to the vice device. The outboard region has two free ends 38, 40. The free ends 38, 40 project linearly from the curved inboard region 36. Each free end of the lower jaw has a cylindrically shaped block 31, 32 affixed to its upper surface.

In the locked orientation, the lower jaw is secured against an lower surface of the two items of various depth. The cylindrical shape of the lower jaw ensures that only a minimum area of the point of abutment between the items are obstructed from welding, glueing and the like. To compensate for the lack of stability afforded by the forgoing design choice, the pair of upper jaws are spaced from the vice and further positioned in parallel relation therewith. It is preferred that the length of the upper jaws are greater than the length of the lower jaw. To afford optimum access to a point of abutment between the upper surface of the items, the upper jaws are linked with a U-shaped member with a space 33 therebetween. To afford similar optimum access to a point of abutment between the lower surface of the items, the lower jaw may be separated into two opposing sections, as shown in FIGS. 9–10.

The invention 10 is made of steel. All critical parts are heat treated to obtain the desired properties of strength and wear resistance and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved self aligning clamp for fixturing two items of unequal thickness together in a stationary relationship in a vice device prior to joining the items together by welding, glueing or the like comprising, in combination:

a base having a fixed rigid lower jaw adapted to receive an underside of the two items of unequal thickness together in a stationary co-planar communication, the lower jaw being disposed transversely to the vice device;

said lower jaw having a solid cylindrical shape and disposed transversely to the base for affording continuous, rigid, unbending contact communication with the two items of unequal thickness; and a swivel having paired, spaced apart, downwardly disposed jaws adapted to receive an upper side of the two items of unequal thickness together in a stationary non-planar communication, each downwardly disposed jaw being oriented above the lower jaw and being disposed parallel to the vice device, the jaws being coupled via a U-shaped member with an aperture in a middle region adapted for threadable rivetable communication with an upper extent of the vice device, each jaw still further having a solid cylindrical shape for urging continuous, rigid, unbending contact communication with the upper side of each item, wherein the U-shaped member and the lower jaw allow access to the point of abutment between the items;

wherein the lower jaw is separated into two sections and a length of each downwardly disposed jaw is eaual to that of each section of the lower jaw.

* * * * *